US008123050B2

(12) United States Patent
Carrillo

(10) Patent No.: US 8,123,050 B2
(45) Date of Patent: Feb. 28, 2012

(54) DISPLAY AND DEMONSTRATION STAND FOR REMOVABLE TRACTION DECKS FOR MINIATURE SKATEBOARDS

(76) Inventor: Corey Michael Carrillo, Solana Beach, CA (US)

( * ) Notice: Subject to any disclaimer, the term of this patent is extended or adjusted under 35 U.S.C. 154(b) by 409 days.

(21) Appl. No.: 12/464,119

(22) Filed: May 12, 2009

(65) Prior Publication Data

US 2010/0288715 A1 Nov. 18, 2010

(51) Int. Cl.
*A47F 7/00* (2006.01)

(52) U.S. Cl. ..... 211/85.7

(58) Field of Classification Search ..... 211/85.2, 211/13.1, 94.01, 85.7, 70.5; 29/428
See application file for complete search history.

(56) References Cited

U.S. PATENT DOCUMENTS 4,161,279 A * 7/1979 Halford ..... 238/10 F
D420,535 S * 2/2000 Klock ..... D6/478
6,073,783 A * 6/2000 Allman ..... 211/85.3
6,145,674 A * 11/2000 Spearman et al. ..... 211/59.1
6,467,632 B1 * 10/2002 Guillot ..... 211/13.1
6,629,677 B2 * 10/2003 Kirshner ..... 248/116
7,793,789 B2 * 9/2010 Psaradellis ..... 211/13.1
2003/0132180 A1 * 7/2003 Chen ..... 211/85.7
2003/0178383 A1 * 9/2003 Craft et al. ..... 211/85.7
2006/0163182 A1 * 7/2006 Borseth ..... 211/85.7
2007/0235400 A1 * 10/2007 Wald ..... 211/85.7
2010/0255918 A1 * 10/2010 Frehner ..... 472/89
2010/0307996 A1 * 12/2010 Kahn ..... 211/85.7

* cited by examiner

*Primary Examiner* — Jennifer E. Novosad
(74) *Attorney, Agent, or Firm* — Eric Hanscom; Todd J. Langford

(57) ABSTRACT

This invention is directed toward a display rack for the sale of removable textured deck applications for miniature skateboards which can also serve as a miniature test course for a prospective purchaser to sample the merchandise before making the decision whether to buy. The display rack has a base heavy enough to keep the display rack upright, with one or more miniature skatepark features such as quarterpipes, grind rails, ramps, steps, or other testing obstacles and surfaces upon which a finger skateboard can be used. Upright members hold horizontal pegs in place from which packaged textured applications can hang.

16 Claims, 10 Drawing Sheets

9A

9B

DISPLAY AND DEMONSTRATION STAND FOR REMOVABLE TRACTION DECKS FOR MINIATURE SKATEBOARDS

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of display racks, and more specifically, to a rack that can display textured deck applications for miniature skateboards which can also serve as a miniature test course for a prospective purchaser. The display rack has a base heavy enough to keep the display rack upright, with one or more quarterpipes, grind rails, ramps, pools, steps, or other testing obstacles and surfaces upon which a finger skateboard can be used. The testing surface is sloped downward to allow for advertising logos and other insignia to be affixed in a viewable location. Upright members hold horizontal pegs in place from which packaged textured applications can hang. Alternatively, the base can be built such that the upright members from which the packages can be hung are built into the base.

The miniature skateboard, or fingerboard, has become one of the most popular toys of the last decade or two. Less than 4 inches long, the miniature skateboard is a portable toy that teaches hand-eye coordination in a manner that many parents find preferable to the same benefits claimed by some video game machines. The fingerboard is controlled generally with two fingers of the same hand, and simulates a real skateboard, with the two fingers serving the same function as the two feet of a rider on a real skateboard.

A major problem in the miniature skateboard market is the fact that finger skateboards are made of plastic and other slick materials, and are used by children in the pre-teen and teenage years, many of whom have dirty, oily or greasy fingers through a combination of skin oil, the eating of greasy food, and a general revulsion at the idea of washing hands.

Thus, the invention of the textured deck application was made to provide a product that allowed users—even those with dirty fingers—to successfully grip the fingerboard as they rode it. Textured deck applications are generally packaged for sale in small transparent packages that could hang from pegs on a wall rack. Because the idea of textured deck applications is so novel, it would be beneficial to allow prospective customers to try out a fingerboard with the textured deck applications already applied so that they can feel first-hand the improvements that they make in fingerboard control. At the current time there is not a rack that allows for a prospective buyer of a fingerboard textured deck application to "test ride" the deck application before buying one.

While there have been a number of "miniature skateboard skateparks", both those sold commercially and those made by hand, none of these has the capacity to hold textured deck applications for sale, nor do any offer the interchangeability of the current invention.

Thus there has existed a long-felt need for a means by which a retail store selling textured deck applications for fingerboards can showcase the product and at the same time provide a testing environment for prospective purchasers.

The current invention provides just such a solution by having a display rack for the sale of removable textured applications for miniature skateboards which can also serve as a miniature test course for a prospective purchaser to sample the merchandise before making the decision whether to buy. The display rack is built with a base that is heavy enough to prevent the rack from tipping over, and has one or more obstacles or items upon which the fingerboard rider can test out a fingerboard with the textured deck application, or even try out his/her own board after purchasing a textured deck application and affixing it to his/her personal fingerboard.

SUMMARY OF THE INVENTION

It is a principal object of the invention to provide a display stand that can both display textured deck applications for fingerboards, and allow prospective purchasers of the textured deck applications to test drive a fingerboard with the textured deck already applied before they decide whether to buy one or not.

It is another object of the invention that the base of the display serve to both stabilize the display and serve as the surface for the fingerboard testing features.

Further objects of the invention include providing an alternative configuration where the upright members that hold the pegs from which the packages hang are built into the base.

It is an additional object of the invention that any obstacle or item found in a fingerboard skateboard park could be incorporated into the display rack such that a fingerboard enthusiast would enjoy playing on the display rack, thereby enhancing the likelihood that the fingerboard enthusiast would purchase something from the retail store utilizing the display rack.

It is a further object of the invention that almost any obstacle or item from a regular or fingerboard skatepark could be used in the display, including but not limited to quarterpipes, grind rails, ramps, pools, and steps.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
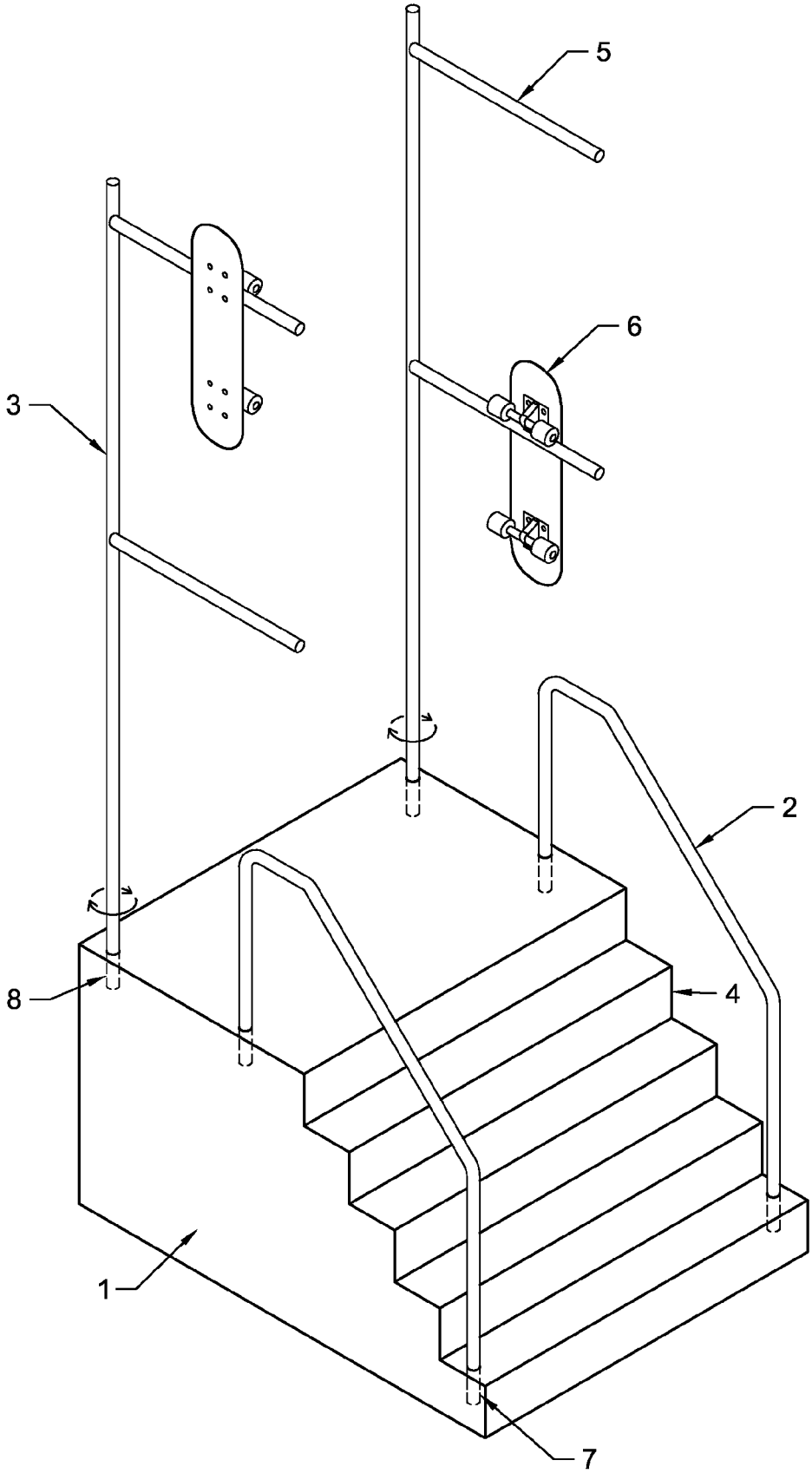
FIG. 1 is a perspective view of the display.

Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a perspective view of the display showing a version of the invention where the base (1) and the upright members (3) are separate pieces, and the testing surfing is a rail (2) over a series of steps (4). The invention in this iteration comprises a base (1), one or more skatepark features (2), one or more vertical members (3), and one or more display pegs (5). The base (1) can be made from a variety of materials, and in this embodiment is relatively plain and simple: it has adequate weight to stabilize the stand and is shaped such that it can accommodate a demonstration fingerboard with the textured deck application already in place, so a prospective buyer can test the product before buying it. In this figure, the skatepark features (2) are two simple rails. The rails are removably attached to the base through holes (7), into which rails or any other skatepark feature with similarly-spaced out attachment locations. The vertical member (3) is attached to the base (1) through holes (5) in the base (1) into which projections from the vertical member (3) are placed. This can be accomplished through dowels and glue or another known method of attaching one object to another. Alternatively, it is contemplated that magnets could be used to attach one part of the invention to another, thereby facilitating the rearrangement of features. In this particular embodiment, the vertical members are not permanently secured, such that they can rotate to better display the miniature skateboards (6). While the ability to move a single rail is not very useful, in looking at later figures, it should be kept in mind that when the base (1) offers a variety of skatepark features, and the retailer using the display has a large number of skatepark features to attach to the display, the retailer has the ability to frequently change the entire appearance of the display, such that the retailer can attract repeat potential customers who will enter the store regularly to try different configurations of the device. Having a product for sale a mere inches above the "testing surface" provides a substantial advertising advantage to the retailer. In advertising, two important considerations are the proximity of an item to a display showing how much fun or useful that item is, and the number of times a retailer can put the advertising image in front of a potential consumer. In the case of this invention, the suggestiveness and viewing repetition of a retail product hanging a mere inches above a testing surface used over the course of hours by a group of prospective buyers is highly beneficial to the retailer's goal of selling fingerboard textured deck applications.

Figure 2:
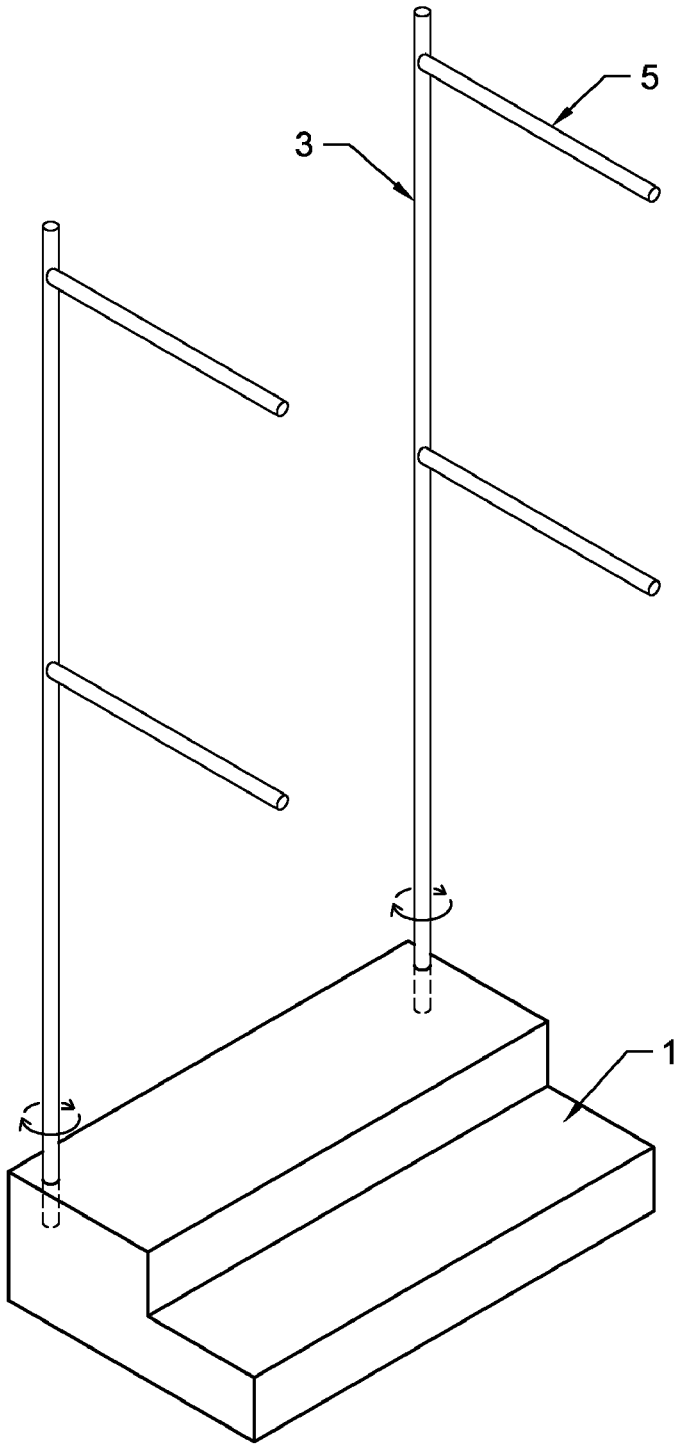
FIG. 2 is a perspective view of another embodiment of the display.

FIG. 2 is a perspective view of another embodiment of the display. The base (1) in this embodiment is a series of 2 large steps, with, optionally, rotating vertical members (3).

Figure 3:
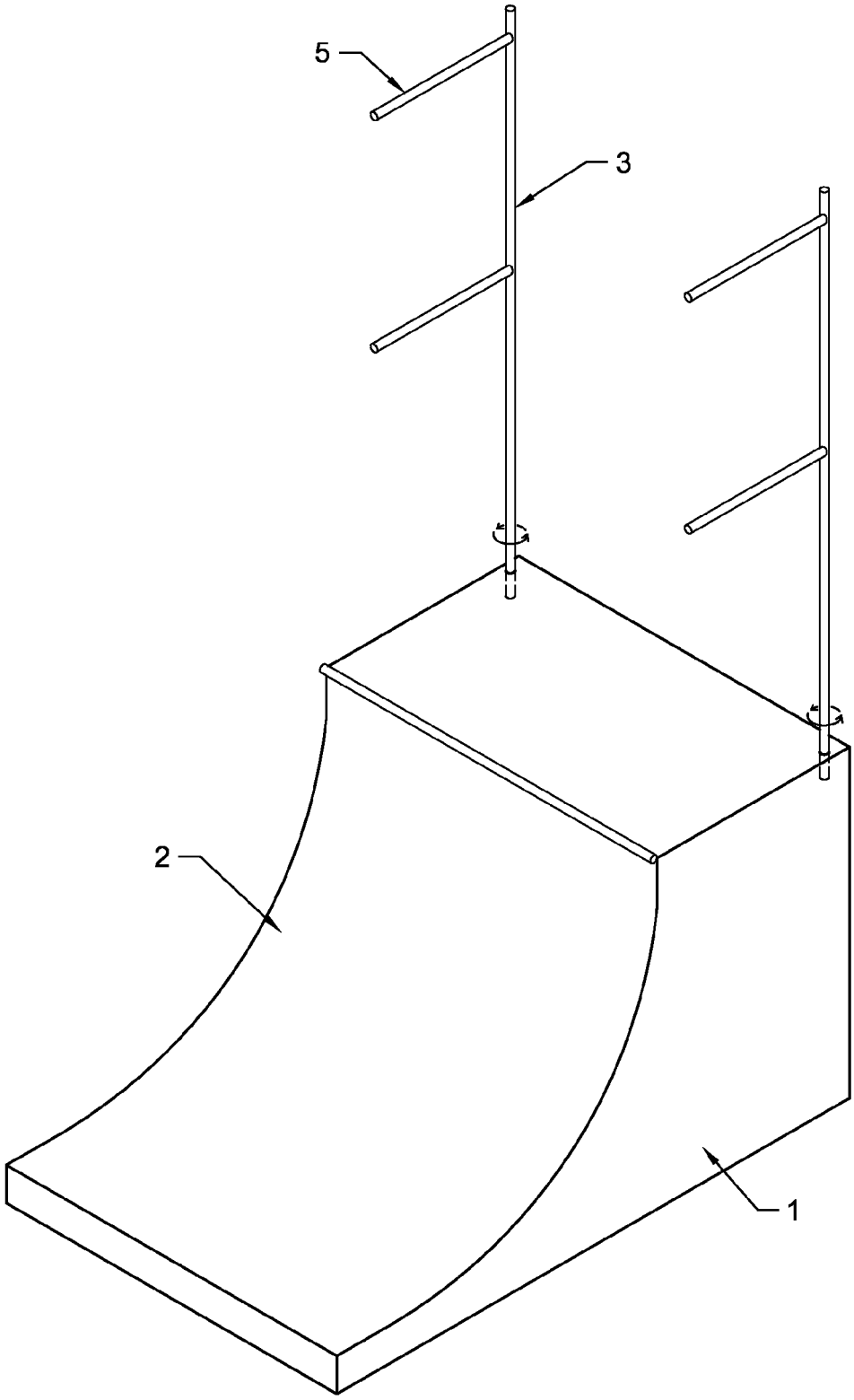
FIG. 3 is a perspective view of another embodiment of the display showing a ramp as the skate park feature.

FIG. 3 is a perspective view of another embodiment of the display showing a ramp (2) as the skate park feature.

Figure 4:
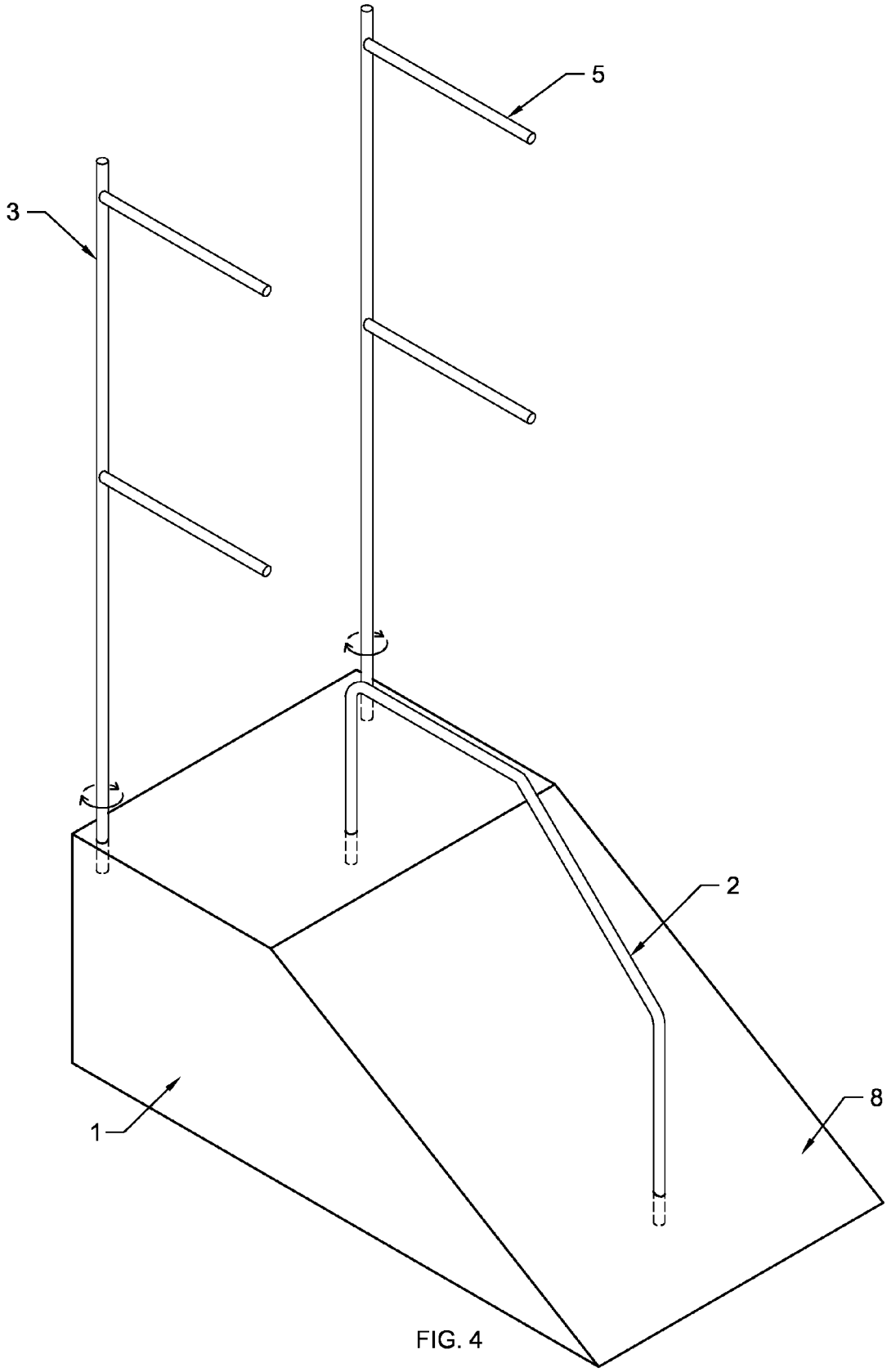
FIG. 4 is a perspective view of another embodiment of the display.

FIG. 4 is a perspective view of another embodiment of the display with a single rail (2) as the skatepark feature over a ramp (8).

Figure 5:
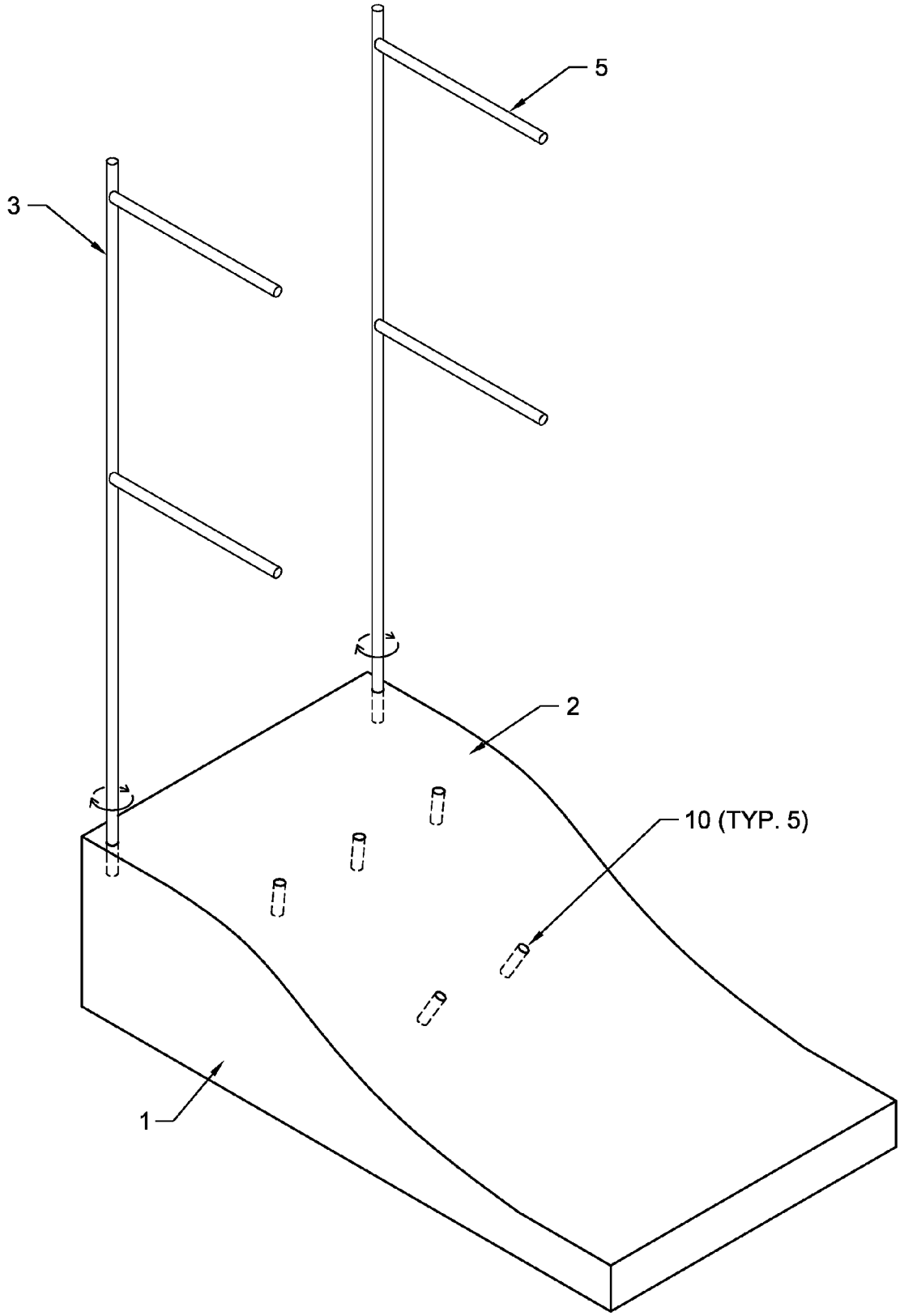
FIG. 5 is a perspective view of another embodiment of the display showing how pre-established holes can be used to move around skate park features to alter the testing surface.

FIG. 5 is a perspective view of another embodiment of the display showing how pre-established holes (10) can be used to move around skate park features to alter the testing surface. In this case the base (1) has a gentle ramp (2) into which a number of holes (10) have been created. The method by which holes can be created is known in the art but generally drilling into a wooden base or creating a mold with holes for plastic bases are contemplated. The holes (10) can be vertical or non-vertical, such that a wide variety of configurations of skatepark features can be created, thereby attracting a return crowd of miniature skatepark enthusiasts to a retail outlet as there are new testing surfaces created whenever the user of the invention decides to change skatepark features around.

Figure 6:
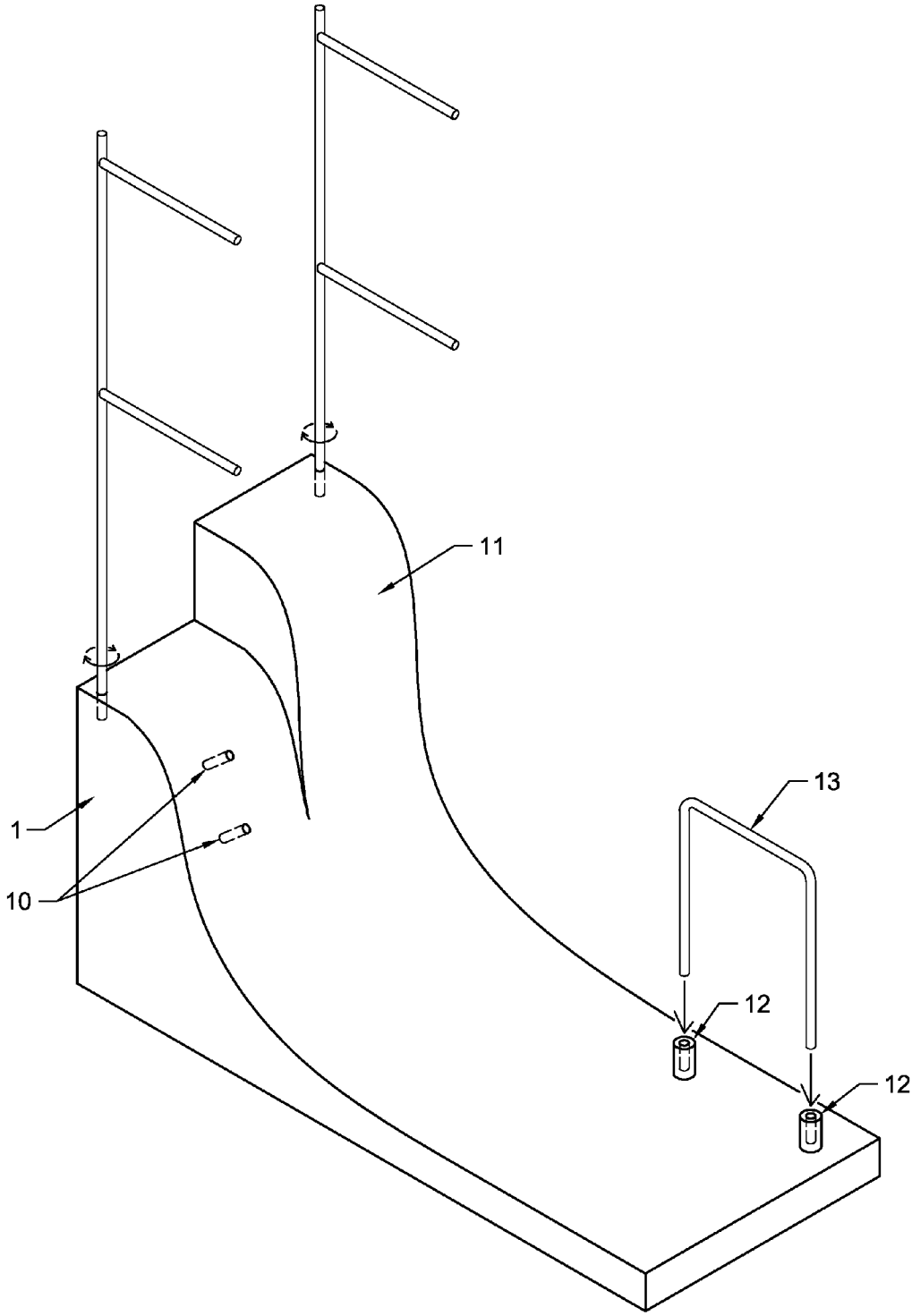
FIG. 6 is a perspective view of another embodiment of the display showing a novel ramp combine with above-surface plugs into which removable skate park features can be removably attached.

FIG. 6 is a perspective view of another embodiment of the display showing a novel ramp (11) combined with above-surface plugs (13) into which removable skate park features (13) can be removably attached. In this embodiment, the ramp (11) splits into two main sections, each of which supports a vertical member with display pegs. The base (1) has holes (10) into which removable skatepark features can be removably attached. In the thinner sections of the base (1), where the base is too thin for holes (10), plugs (12) can be attached to allow for removable skatepark features (13) to be inserted and changed out. The plugs (12) can be permanently applied through glue or other permanent means of attachment, or removably attached through magnets, hook and loop tape, or other removable means of attachment.

Figure 7:
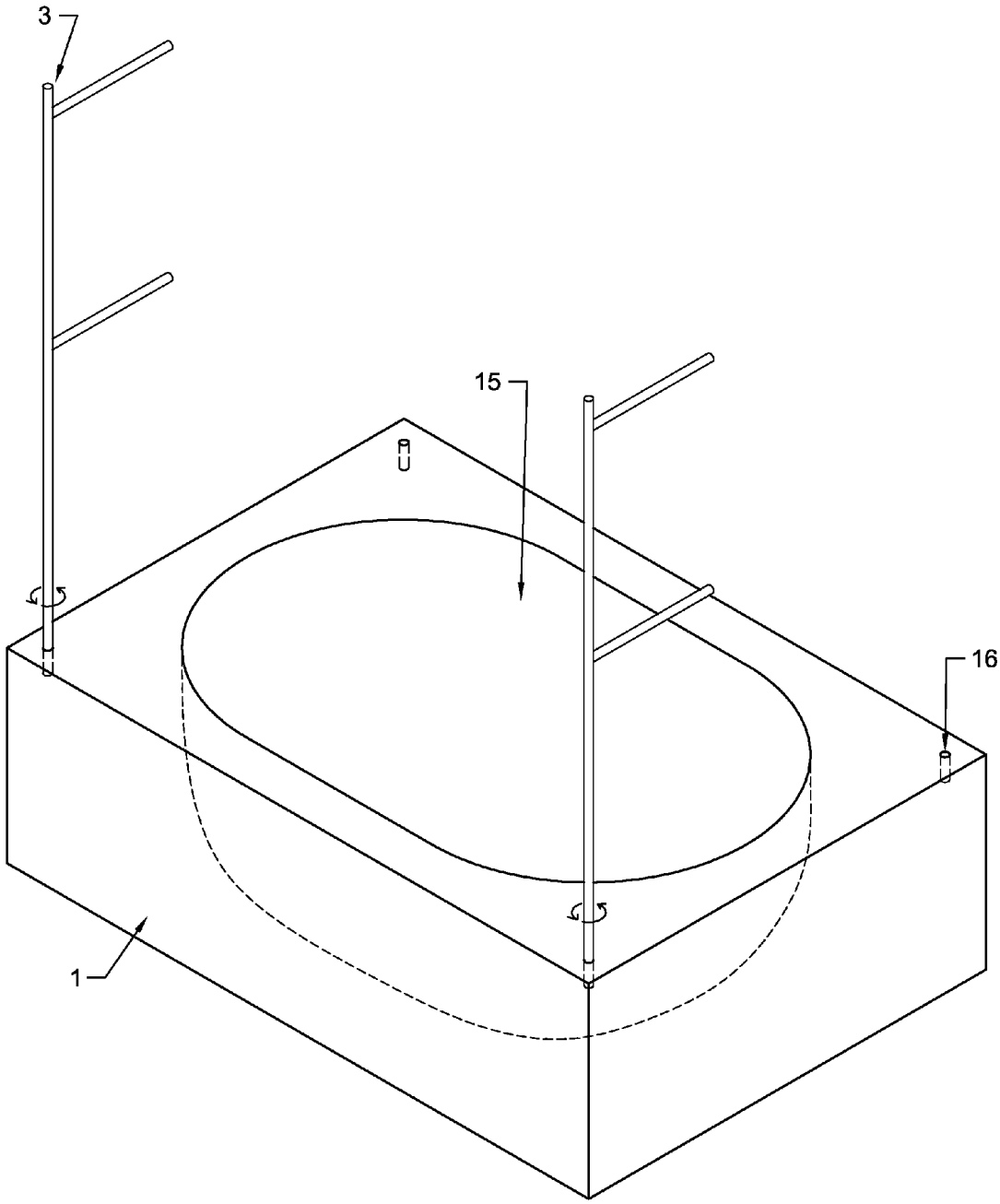
FIG. 7 is a perspective view of another embodiment of the display showing a pool as a skate park feature along with pre-established holes that can hold both the upright members or skate park features.

FIG. 7 is a perspective view of another embodiment of the display showing a pool (15) as a skate park feature along with pre-established holes (16) that can hold both the upright members or skate park features. In other embodiments, the holes into which the vertical members fit were considerably larger than those into which the skatepark features fit, but in this embodiment, the holes are all the same diameter, such that the vertical members and skatepark features can be interchanged using the same holes.

Figure 8:
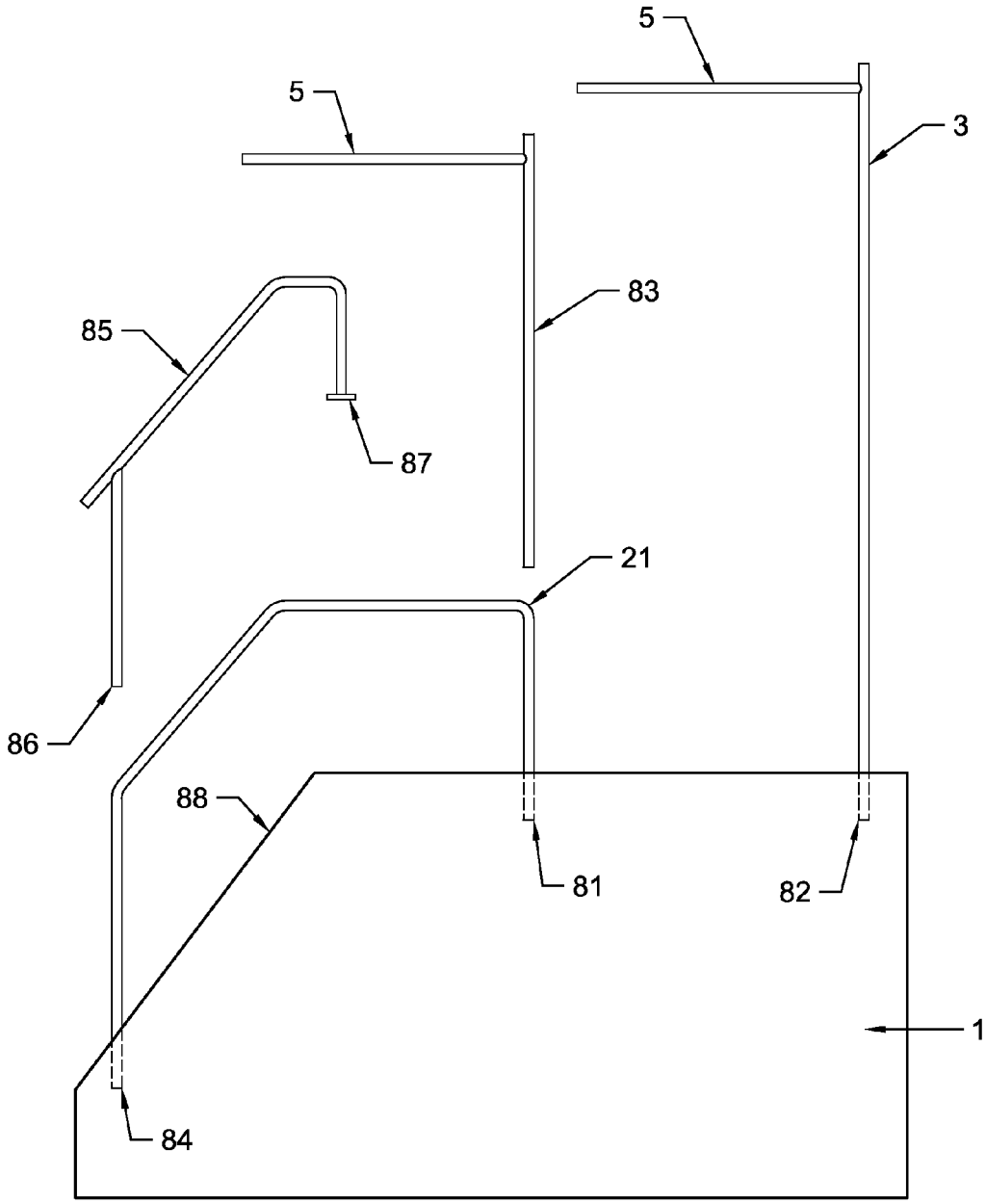
FIG. 8 is a cross-sectional view of the display showing a version of the invention where the base and the upright members are separate pieces, and the testing surface is a rail.

FIG. 8 is a cross-sectional view of the display showing a version of the invention where the base (1) and the upright members (3) are separate pieces, and the testing surface is a rail (21). This figure also illustrates that another upright member (83) with a peg (5) can be inserted into the upper hole (81) vacated by removal of the rail (21), and that another feature, such as a half-rail (85) and be inserted into the lower hole (84), through a stand (86) of a slightly smaller diameter, with a stabilizing stand (87) on the upper end of the half-rail (85), which allows the half-rail to sit above the ramp (88).

Figure 9:
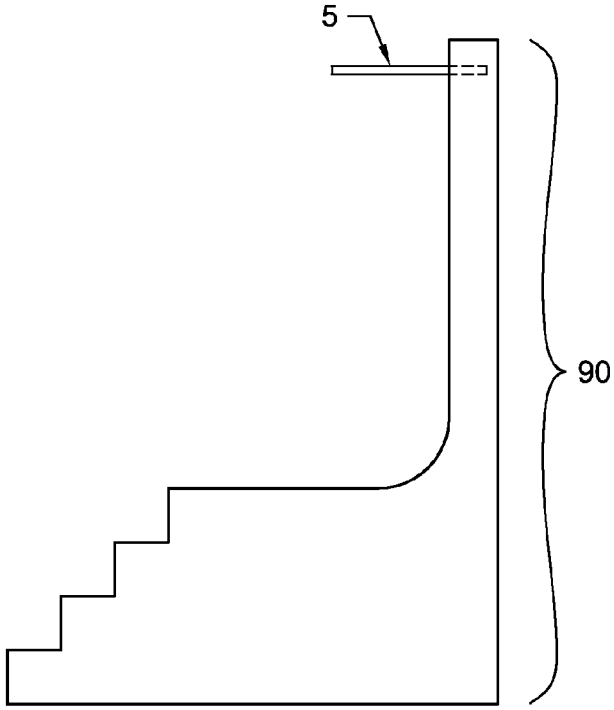
FIG. 9 is a cross-sectional view of an alternative embodiment of the invention where the base and upright members are molded or manufactured as a single unit.
Figure 9:
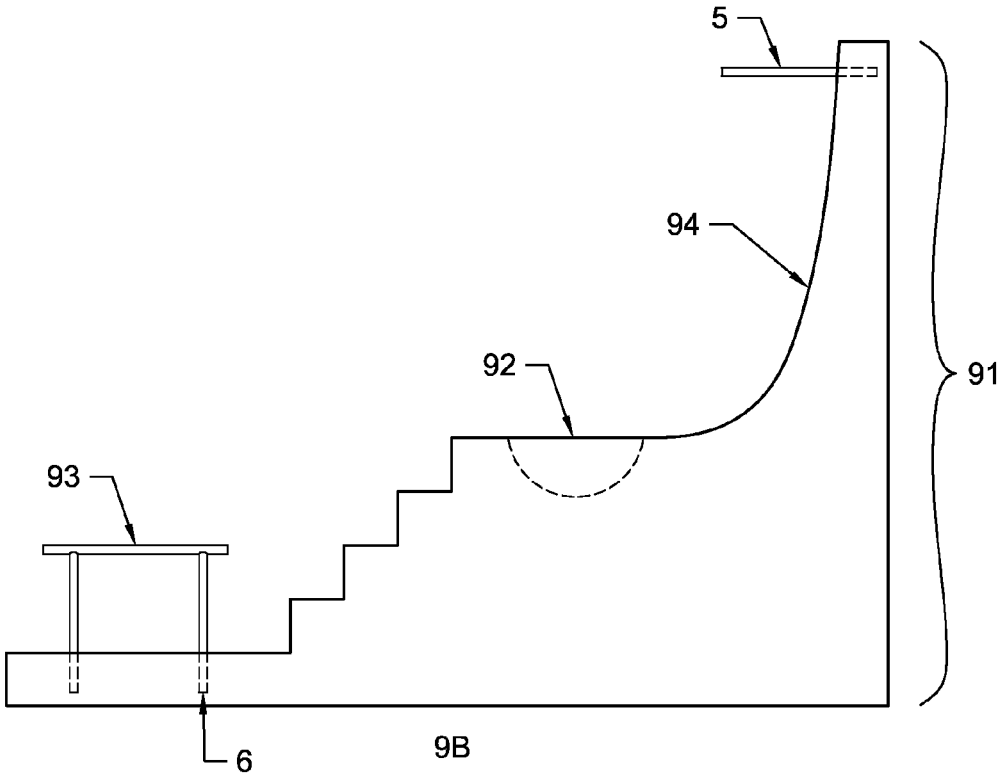

FIG. 9 is a cross-sectional view of an alternative embodiment of the invention where the base and upright members are molded or manufactured as a single unit. In FIG. 9A, the base (90) serves the function of stabilizing the display unit, and has upward projecting sections from which pegs (5) extend. In FIG. 9B this particular display, a pool (92) has been manufactured into the base (1), and a park bench (93) have been attached to the base through means of attachment (6). The curvature (94) of the unit also gives it a ramp for testing of miniature skateboards.

Figure 10:
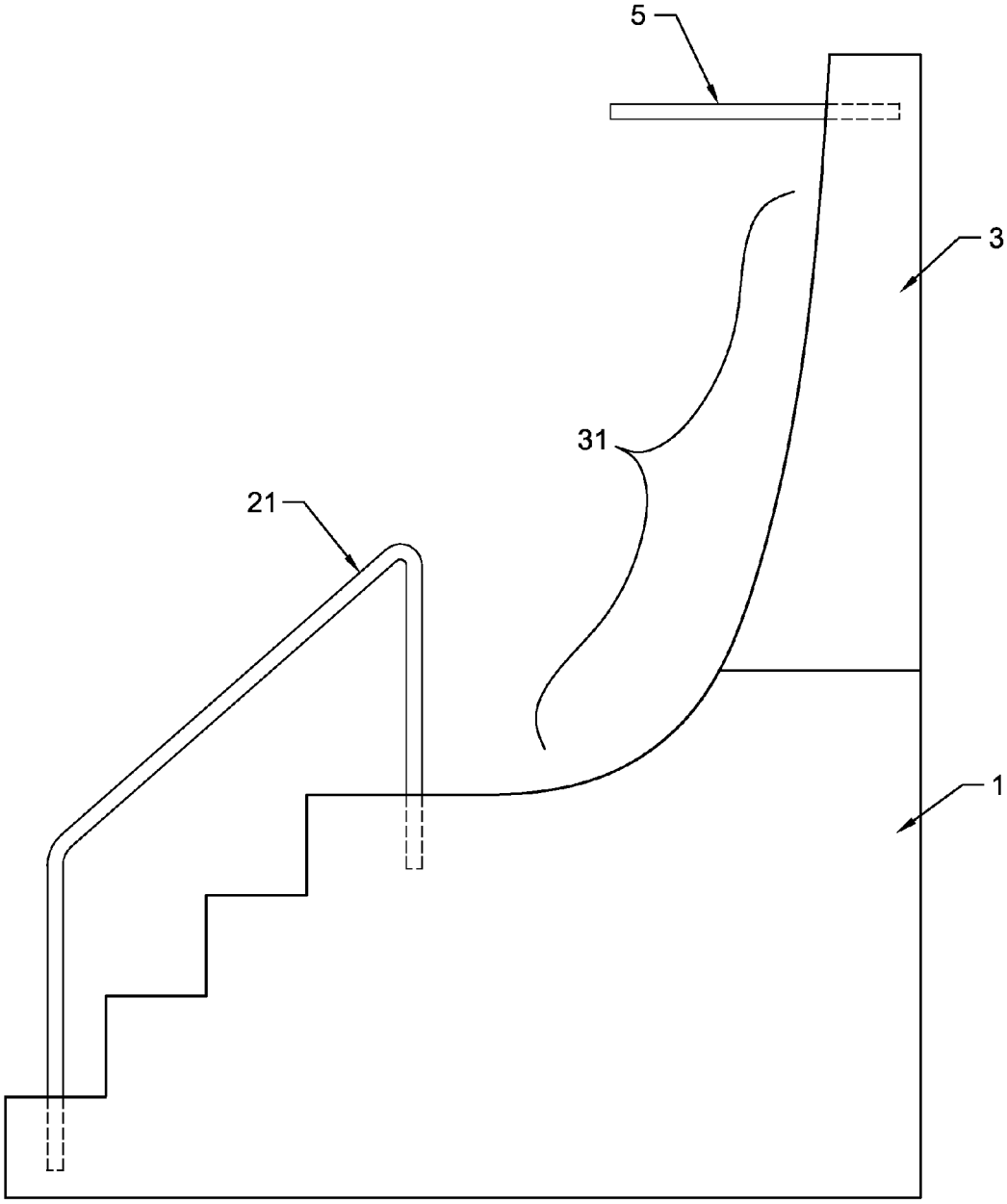
FIG. 10 is a cross-sectional view of another embodiment of the invention, where the upright member has a curved surface which mates with a curved surface in the base to create a ramp with a continuously curving surface.

FIG. 10 is a cross-sectional view of another embodiment of the invention, where the upright member (3) has a curved surface which mates with a curved surface in the base (1) to create a ramp (31) with a continuously curving surface.

From a financial perspective, the goal of the display is two-fold. First, it is desirable that for a new product, such as the textured deck application, a prospective customer has a chance to test drive the product before buying it. Having a display rack that also has a miniature skatepark built into and onto its surface provides just such a testing surface. The retail owner can take an existing fingerboard and apply on its deck one of the textured deck applications such that prospective purchasers of the textured deck applications can see the improved handling of the fingerboard before making their purchase. Second, it is desirable to have customers come into a retail store on a regular basis. This is particularly important in the trendy world of pre-teens and teens. Certain skateboard shops and surf shops are seen as decidedly more "cool" than other such retail locations, and attract a regular and loyal customer base. By providing an ever-changing miniature skatepark on the display, the retail shop will encourage its regular customers to come in more frequently so that they can try out the new configurations.

The base can be made from wood, plastic, metal, or any other material that can be carved, molded, or manipulated into having a surface that has at least one skatepark feature. For example, if the skatepark feature is a pool, a plastic base could be molded with a pool indented into the surface. For a grind rail, a wooden base would serve well, with holes drilled into the wood into which the ends of the grind rail could be inserted and glued into place. The key features of the base are that a) it is heavy enough to stabilize the display rack such that it doesn't fall over during use, and b) that it can effectively provide one or more features of a skatepark. It is also contemplated that less invasive methods of temporarily affixing the features and the vertical members to the base could be used. In particular, strong magnets of opposite poles could be attached to the base and the bottom on the vertical members and features, such that the miniature skatepark could be quickly and easily rearranged.

The skatepark feature can be built into the base, such as with a pool or steps. It can also be attached through drilling (or molding into the base model) a plurality of holes, such that a skatepark feature that exists above the ground, such as with a quarterpipe or grind rail, could be mounted. Drilling or molding multiple holes in the base would allow the retail shop owner to frequently swap out and move around the skatepark features, thereby enhancing the attractiveness of the display to the customers.

What I claim is:

1. A display stand for displaying textured deck applications for fingerboard miniature skateboards and allowing for the testing of the textured deck applications on fingerboard miniature skateboards, comprising a base, one or more upright members, one or more pegs, and one or more miniature skatepark features for use by fingerboards, where each of the one or more upright members is connected to the base by a means of attachment, where the base has a front face, a back face, a bottom face, a top face, a right side face and a left side face, four or more holes, two plugs, and a means of attachment by which each skatepark feature is connected to the base, where each of the one or more pegs is attached to one of the one or more upright members, where the holes are located on the base such that a free-standing item can be attached to the base in more than one location, and where the two plugs are mounted to an exterior of the base into which at least two different skatepark features are mounted.

2. The display stand of claim 1, where the one or mores skatepark features is selected from the group consisting of: pools, steps, ramps, quarterpipes, and grind rails.

3. The display stand of claim 1, where the one or more skatepark features comprises an embedded item built into the base, and the embedded item is selected from the group consisting of: pools, ramps, and steps.

4. The display stand of claim 1, where the one or more skatepark features comprises a free-standing item that is attached to the base, where the free-standing item but has at least a portion of its body above the base, and where the free-standing item is selected from the group consisting of: quarterpipes, bank and rails, picnic tables, Step and Ledges, and grind rails.

5. The display stand of claim 1, where at least one of the one or more upright members has front section, which faces the front of the display stand, and a back section, which faces the back of the base, where the front section has a curved surface, and where the top section of the base has a curved section, and where the curved surface of the front section and the curved section of the base have curves that form a continuously curving surface.

6. The display stand of claim 5, where the continuously curving surface extends from the right side of the base to the left side of the base.

7. The display stand of claim 6, where the means of attachment are magnets.

8. A display stand for displaying textured deck applications for fingerboard miniature skateboards and allowing for the testing of the textured deck applications on fingerboard miniature skateboards, comprising a base, where the base additionally comprises one or more upright members, one or more pegs, and one or more miniature skatepark features for use by fingerboards, where each of the one or more upright members is connected to the base, where the base has a front face, a back face, a bottom face, a top face, a right side face and a left side face, and each of the one or more pegs is attached to one of the one or more upright members where the one or mores skatepark features is selected from the group consisting of: pools, steps, ramps, quarterpipes, and grind rails, and where the display standing additionally comprises at least two plugs which are capable of being mounted to an exterior of the base, and into which at least two different skatepark features can be mounted.

9. The display stand of claim 8, where the one or more skatepark features comprises an embedded item built into the base, and the embedded item is selected from the group consisting of: pools, ramps, and steps.

10. The display stand of claim 8, where the base additionally comprises a plurality of holes, and the number of holes is at least four, and the holes are located on the base such that a free-standing item can be attached to the base in more than one location.

11. The display stand of claim 8, where at least one of the one or more upright members has front section, which faces the front of the display, and a back section, which faces the back of the base, where the front section has a curved surface, and where the top section of the base has a curved section, and where the curved surface of the front section and the curved section of the base have curves that form a continuously curving surface.

12. The display stand of claim 11, where the continuously curving surface extends from the right side of the base to the left side of the base.

13. The display stand of claim 8, wherein the display stand further comprises a means of attachment, where the means of attachment connects the one or more upright members to the base, where the means of attachment are magnets.

14. A method of making a display stand for displaying textured deck applications for fingerboard miniature skateboards and allowing for the testing of the textured deck applications on fingerboard miniature skateboards, where the display stand comprises a base, one or more upright members, one or more pegs, and one or more miniature skatepark features for use by fingerboards, where each of the one or more upright members is connected to the base by a means of attachment, where the base has a front face, a back face, a bottom face, a top face, a right side face and a left side face, and a means of attachment by which each skatepark feature is connected to the base, and where each of the one or more pegs is attached to one of the one or more upright members, comprising the steps of: first, creating a base unit, second, attaching one or more upright members to the base unit by upright member means of attachment, third, attaching one or more skatepark features to the base by feature means of attachment, where the display stand additionally comprises at least two plugs which are capable of being mounted to an exterior of the base, and into which at least two different skatepark features can be mounted.

15. The method of claim 14, where the one or more skatepark features are at least two in number, and comprise at least one embedded item, where the embedded item is built into the base, and at least one free-standing item, where the free-standing item is attached to the base, where the free-standing item has at least a portion of its body above the base, and where the one or more free-standing items is selected from the group consisting of: quarterpipes, bank and rails, picnic tables, Step and Ledges, and grind rails, and where the one or more embedded items is selected from the group consisting of: pools, ramps, and steps, and, where the base additionally comprises a plurality of holes, and the number of holes is at least four, and the holes are located on the base such that a free-standing item can be attached to the base in more than one location.

16. The method of claim 14, where at least one of the one or more upright members has a front section, which faces the front of the display stand, and a back section, which faces the back of the base, where the front section has a curved surface, and where the top section of the base has a curved section, and where the curved surface of the front section and the curved section of the base have curves that form a continuously curving surface, and, where the means of attachment are magnets.

* * * * *